US011615753B2

(12) United States Patent
Lee

(10) Patent No.: US 11,615,753 B2
(45) Date of Patent: Mar. 28, 2023

(54) CONTROL CIRCUIT APPLIED TO DISPLAY AND ASSOCIATED CONTROL METHOD

(71) Applicant: Realtek Semiconductor Corp., HsinChu (TW)

(72) Inventor: Wan-Jou Lee, HsinChu (TW)

(73) Assignee: Realtek Semiconductor Corp., HsinChu (TW)

( * ) Notice: Subject to any disclaimer, the term of this patent is extended or adjusted under 35 U.S.C. 154(b) by 0 days.

(21) Appl. No.: 17/465,873

(22) Filed: Sep. 3, 2021

(65) Prior Publication Data

US 2022/0262324 A1 Aug. 18, 2022

(30) Foreign Application Priority Data

Feb. 18, 2021 (TW) ..... 110105528

(51) Int. Cl.
*G09G 3/34* (2006.01)
*G09G 3/36* (2006.01)

(52) U.S. Cl.
CPC ..... *G09G 3/3426* (2013.01); *G09G 3/3611* (2013.01); *G09G 2320/0233* (2013.01); *G09G 2320/0242* (2013.01); *G09G 2320/0247* (2013.01); *G09G 2320/064* (2013.01)

(58) Field of Classification Search
None
See application file for complete search history.

(56) References Cited

U.S. PATENT DOCUMENTS

| | | | | |
|---|---|---|---|---|
| 11,205,400 | B1 * | 12/2021 | Jang | G09G 5/10 |
| 2010/0066754 | A1 * | 3/2010 | Kuroda | G09G 3/3406 345/589 |
| 2015/0109286 | A1 * | 4/2015 | Verbeure | G09G 3/36 345/419 |
| 2015/0243233 | A1 * | 8/2015 | Bloks | G09G 3/3614 345/96 |
| 2015/0379918 | A1 * | 12/2015 | Tann | G09G 3/20 345/209 |

FOREIGN PATENT DOCUMENTS

| | | | |
|---|---|---|---|
| CN | 111354323 | A | 6/2020 |
| CN | 111833802 | A | 10/2020 |
| TW | 201447842 | A | 12/2014 |

* cited by examiner

*Primary Examiner* — Chad M Dicke
(74) *Attorney, Agent, or Firm* — Winston Hsu

(57) ABSTRACT

A control circuit applied to a display includes a receiving interface, an image processing circuit, and a backlight control circuit. The receiving interface is arranged to receive an image data from an image source, wherein the image data has an unfixed frame rate. The image processing circuit is arranged to receive the image data from the receiving interface and determine a frame rate of the image data. The backlight control circuit is arranged to generate a control signal to a display panel according to the frame rate, to control brightness of a backlight module of the display panel.

11 Claims, 9 Drawing Sheets

CONTROL CIRCUIT APPLIED TO DISPLAY AND ASSOCIATED CONTROL METHOD

BACKGROUND OF THE INVENTION

1. Field of the Invention

The present invention is related to a control method for a liquid crystal display (LCD) panel.

2. Description of the Prior Art

A driving circuit of an LCD panel includes a source driver and a gate driver, wherein the gate driver is arranged to charge a pixel array of the LCD panel row by row, and the source driver receives pixel data and work with the gate driver to write the pixel data into the pixel array. The time for the gate driver to charge the pixel array row by row may be affected by the specification of the LCD panel. Take an LCD with a fixed frequency of 60 Hz as an example. It is assumed that the size of the processed frame is 2200*1125, the pixel clock frequency may be set to 148.5 MHz (i.e. 2200*1125*60 Hz=148.5 MHz), and the charging time of each row in the pixel array is 14.815 microseconds.

In addition, considering a case where the speed of image data generated by the image source is not fixed, some LCDs currently adopt a variable refresh rate (VRR) display method. That is, the frame rate of the images displayed by an LCD varies with the rate of the received image data (i.e. the LCD does not have a fixed frame rate). In practice, the LCD may achieve the effect of changing the frame rate by changing the number of vertical blanking intervals under the condition of using a fixed pixel clock frequency. FIG. 1 is a diagram illustrating driving of an LCD panel under different pixel clock frequencies and frame rates. Take the two timing diagrams at the top of FIG. 1 for example. It is assumed that the current pixel clock frequency (P_CLK) is 297 MHz, the frame rate is 120 Hz (i.e. display time of a frame is 8.33 milliseconds), and the number of rows of the frame (Vtotal) is 1125. Once the frame rate of the LCD panel needs to be switched to 60 Hz, the number of rows of the frame may be increased to 2250, wherein the added rows belong to the vertical blanking interval and will not be displayed on the screen. However, this method will encounter the problem of inconsistent current leakage time of pixel capacitors, which will cause the brightness and/or color of the image frame to be different. Specifically, taking the two timing diagrams at the top of FIG. 1 for example, the slashed area may be regarded as the charging stage, which corresponds to the part of the frame that needs to be displayed on the screen (e.g. the size of the frame is 2200*1125, but only the active area of 1920*1080 will be displayed on the screen). The remaining part corresponding to the vertical blanking interval is regarded as the voltage holding stage. Since durations of voltage holding stages illustrated in the two timing diagrams at the top of FIG. 1 are different from each other, the brightness and/or color of the displayed images will be different due to the difference in the current leakage time of the pixel capacitors, which may cause the screen to flicker.

On the other hand, by comparing the two timing diagrams at the bottom of FIG. 1, it may also be found that using different pixel clock frequencies to drive image content with the same frame rate may also correspond to voltage holding stages with different durations. That is, there will also be differences in the brightness and/or color of the images.

SUMMARY OF THE INVENTION

It is therefore an objective of the present invention to provide a control method for an LCD panel. The control method may dynamically adjust backlight brightness or image display data according to a frame rate, to address the above-mentioned problems in the prior art.

In an embodiment of the present invention, a control circuit applied to a display is provided. The control circuit includes a receiving interface, an image processing circuit, and a backlight control circuit. The receiving interface is arranged to receive an image data from an image source, wherein the image data has an unfixed frame rate. The image processing circuit is arranged to receive the image data from the receiving interface, and determine a frame rate of the image data. The backlight control circuit is arranged to generate a control signal to a display panel according to the frame rate, to control brightness of a backlight module of the display panel.

In an embodiment of the present invention, a control circuit applied to a display is provided. The control circuit includes a receiving interface and an image processing circuit. The receiving interface is arranged to receive an image data from an image source, wherein the image data has an unfixed frame rate. The image processing circuit is arranged to receive the image data from the receiving interface, and determine a frame rate of the image data, and adjust pixel values of the image data according to the frame rate, to generate an output image data and output to a display panel.

In an embodiment of the present invention, a control method applied to a display is provided. The control method includes: receiving an image data from an image source, wherein the image data has an unfixed frame rate; determining a frame rate of the image data; and generating and outputting a control signal to a display panel according to the frame rate, to control brightness of a backlight module of the display panel.

In an embodiment of the present invention, a control method applied to a display is provided. The control method includes: receiving an image data from an image source, wherein the image data has an unfixed frame rate; and determining a frame rate of the image data, and adjusting pixel values of the image data according to the frame rate, to generate an output image data and output to a display panel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
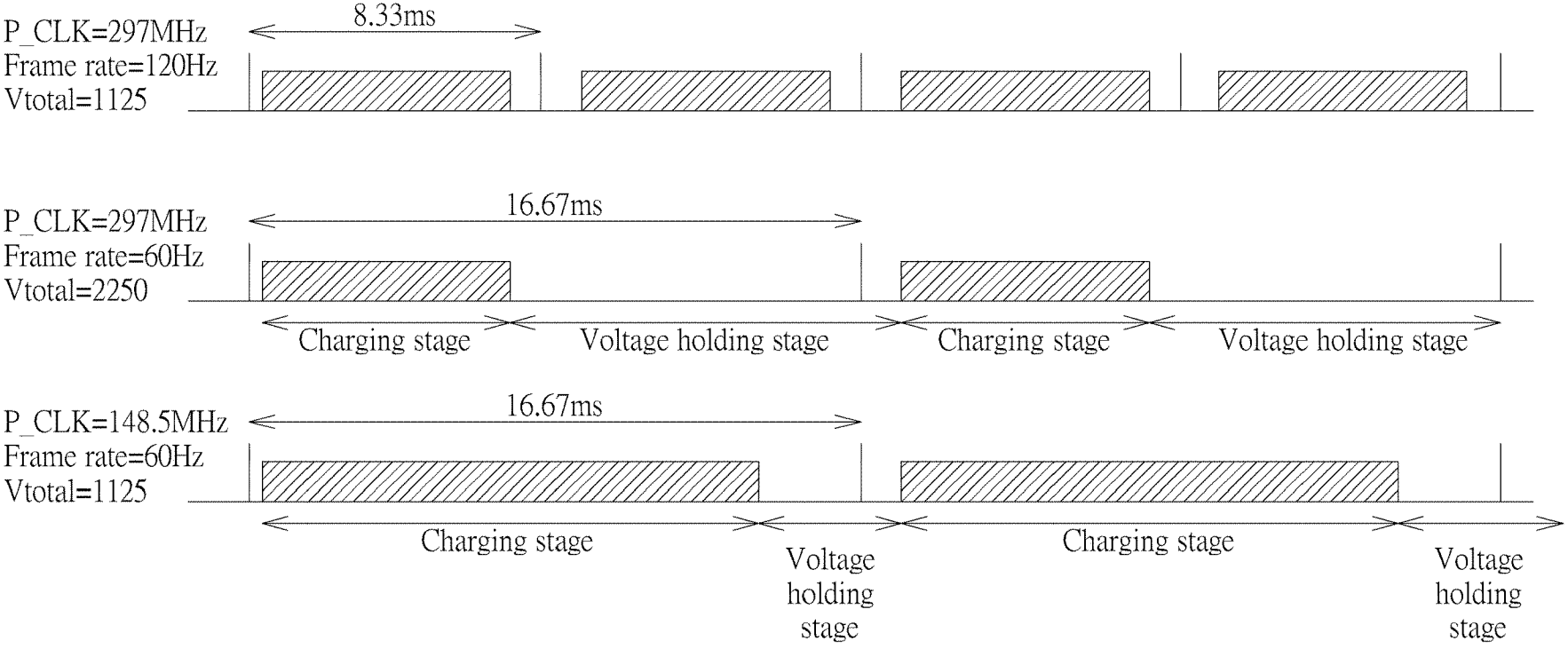
FIG. 1 PRIOR ART
FIG. 1 is a diagram illustrating driving of an LCD panel under different pixel clock frequencies and frame rates.
Figure 2:
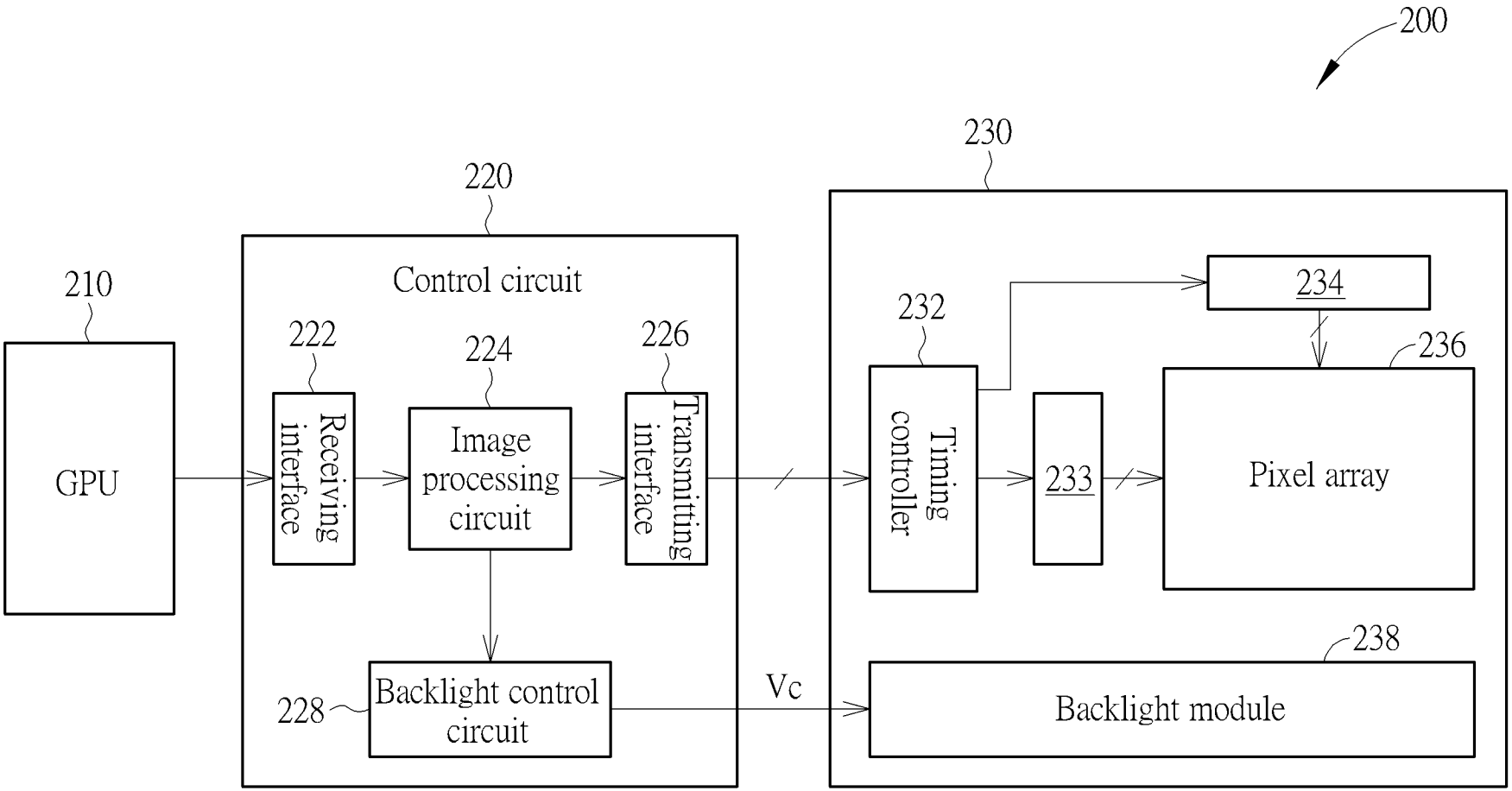
FIG. 2 is a diagram illustrating a display according to an embodiment of the present invention.

FIG. 2 is a diagram illustrating a display 200 according to an embodiment of the present invention. As shown in FIG. 2, the display 200 includes a control circuit 220 and a display panel 230. A graphics processing unit (GPU) 210 of an image source (e.g., a computer) is coupled to the control circuit 220 of display 200. In this embodiment, the control circuit 220 includes a receiving interface 222, an image processing circuit 224, a transmitting interface 226, and a backlight control circuit 228, wherein the receiving interface 222 is arranged to receive an image data from the GPU 210, and then transmit the received image data to image processing circuit 224 for image processing, and the image processing circuit 224 may adjust brightness, color, or format of the received image data to generate and output an output image data to the transmitting interface 226 that transmits the output image data to the display panel 230 for displaying. In addition, the backlight control circuit 228 is arranged to generate a control signal Vc to control the brightness of the display panel 230, wherein the control signal Vc may be a pulse-width modulation (PWM) signal. In an embodiment of the present invention, the control circuit 220 is a scaler integrated circuit. The display panel 230 includes a timing controller 232, a gate driver 233, a source driver 234, a pixel array 236, and a backlight module 238, wherein the timing controller 232 receives an image data from the control circuit 220 and then generates corresponding gate driving signal and source driving signal to the gate driver 233 and the source driver 234, for controlling the pixel array 236 to display an image frame. In addition, the backlight module 238 receives the control signal Vc to illuminate with the corresponding brightness.

The display 200 shown in FIG. 2 supports a variable refresh rate (VRR) display method. That is, a frame rate of an output image data generated by the control circuit 220 is equal to a frame rate of an image data generated by the GPU 210. As mentioned in the description of the prior art, a frame rate of images that need to be displayed by the display panel 230 will change with the speed of the GPU 210 generating the image data. As a result, in different frame rates, the pixel array 236 has a large difference in the duration of the voltage holding stage, which may cause the brightness and/or color of the displayed image to be different, and may cause the screen to flicker. To address this issue, the present embodiment proposes a backlight control method, wherein the backlight control circuit 228 may generate the control signal Vc according to the frame rate of the image frame that is currently processed, to dynamically adjust the brightness of the backlight module 238, thereby preventing image brightness and/or color nonuniformity.

Figure 3:
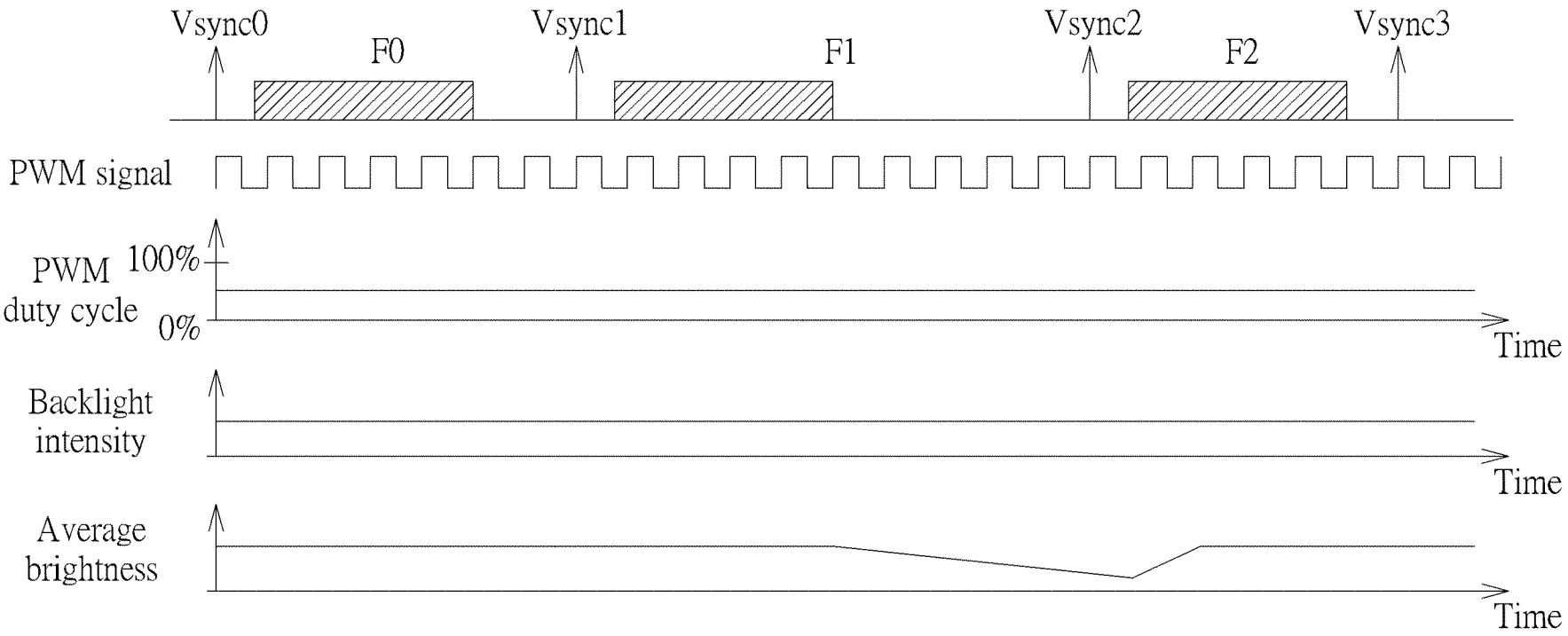
FIG. 3 PRIOR ART
FIG. 3 is a diagram illustrating image brightness and/or color nonuniformity according to the prior art.

To highlight the improvement of image brightness and/or color nonuniformity that is achieved by this embodiment, please refer to FIG. 3 first. FIG. 3 is a diagram illustrating image brightness and/or color nonuniformity according to the prior art. In FIG. 3, it is assumed that the display panel 230 is a normally black liquid crystal display (LCD) panel, the displayed image frames F0, F1, and F2 have a same content, the backlight brightness remains the same (i.e. the PWM signal arranged to control the backlight module has a fixed duty cycle such as 50%), and the frame rate of the image frame F1 is lower than that of the image frame F0 (i.e. the display time of the image frame F1 is longer than that of the image frame F0). In FIG. 3, the image frame F0 is a region between a vertical sync signal Vsync0 and a vertical sync signal Vsync1, the image frame F1 is a region between the vertical sync signal Vsync1 and a vertical sync signal Vsync2, the image frame F2 is a region between the vertical sync signal Vsync2 and a vertical sync signal Vsync3, and the slash part (which may be called the active display region) is the time in which the gate driver 233 and the source driver 234 drive the pixel array 236 to display the image frame, and the region outside the active display region of the image frame is the vertical blanking interval, wherein a region before the active display region may be called a vertical back porch region, and a region after the active display region may be called a vertical front porch region. As shown in FIG. 3, the image frame F1 has a lower frame rate (i.e. the image frame F1 has a longer vertical front porch region). As a result, the average image brightness generated by the display panel 230 in the vertical front porch region of the image frame F1 will gradually decrease due to a longer current leakage time of the pixel capacitors. Therefore, the image brightness and/or color is nonuniform.

Figure 4:
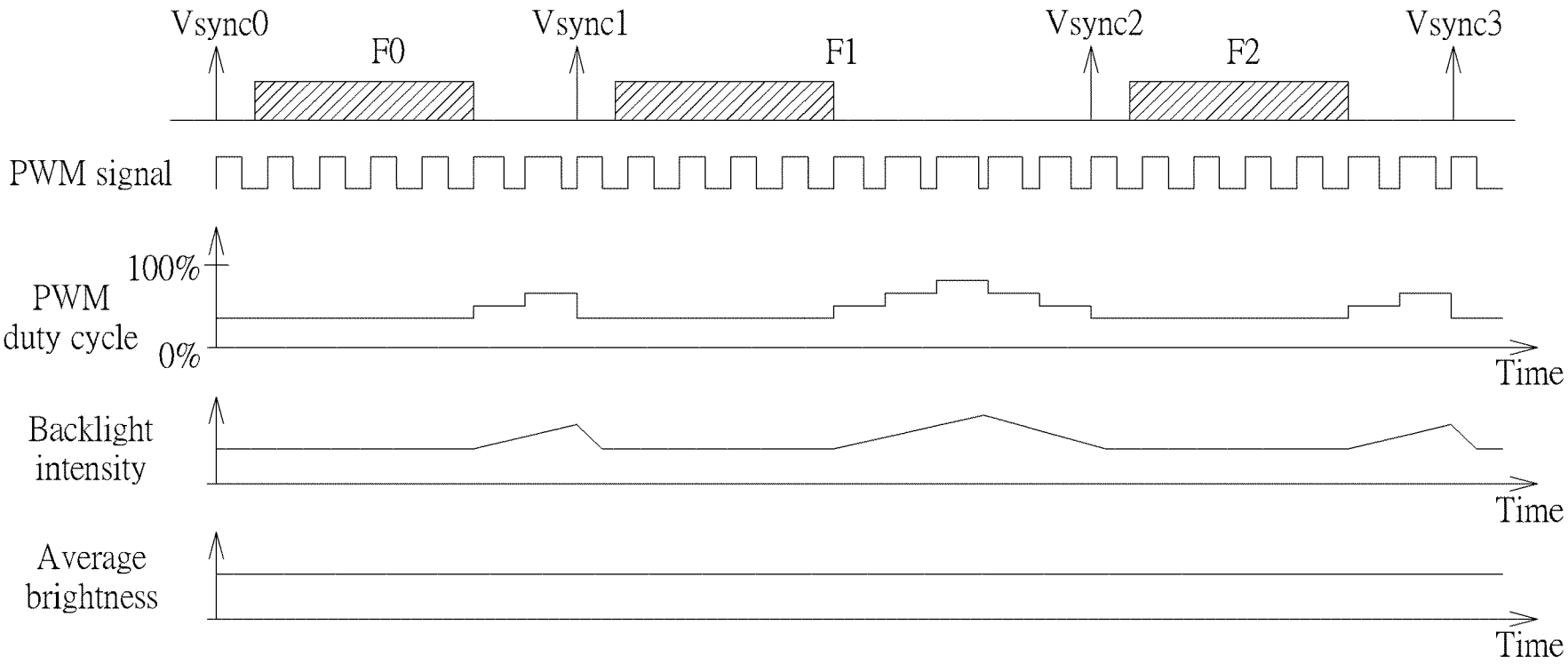
FIG. 4 is a timing diagram illustrating an embodiment of the present invention that is arranged to improve the image brightness and/or color nonuniformity shown in FIG. 3.

To address the problem shown in FIG. 3, please refer to FIG. 4. FIG. 4 is a timing diagram according to an embodiment of the present invention. As shown in FIG. 4, the backlight control circuit 228 determines whether to change the brightness of the backlight module 238 in the vertical front porch region according to the frame rate of the current image frame, to compensate for the decrease of the average image brightness due to the longer vertical front porch region of the image frame F1. Specifically, when the image processing circuit 224 receives the image data from the GPU 210, the image processing circuit 224 delays for a period of time before generating an output image data to the display panel 230, wherein the output image data includes an image data, a vertical sync signal, a horizontal sync signal, etc. If the image processing circuit 224 determines that the image frame F1 has a lower frame rate (e.g. the image frame F2 is not received in a period of time), the control signal Vc (e.g. the PWM signal) generated by the backlight control circuit 228 has a longer duty cycle. That is, the backlight module 238 has a higher brightness in the vertical front porch region of the image frame F1, to make the average brightness displayed by the display panel 230 consistent.

It should be noted that, in the embodiment of FIG. 4, the active display region of the image frame F0 and the active display region of the image frame F1 correspond to a same backlight intensity, to maintain a normal frame display. In another embodiment, the active display region of the image frame F0, the active display region of the image frame F1, the vertical back porch region of the image frame F0, and the vertical back porch region of the image frame F1 may correspond to a same backlight intensity.

Figure 5:
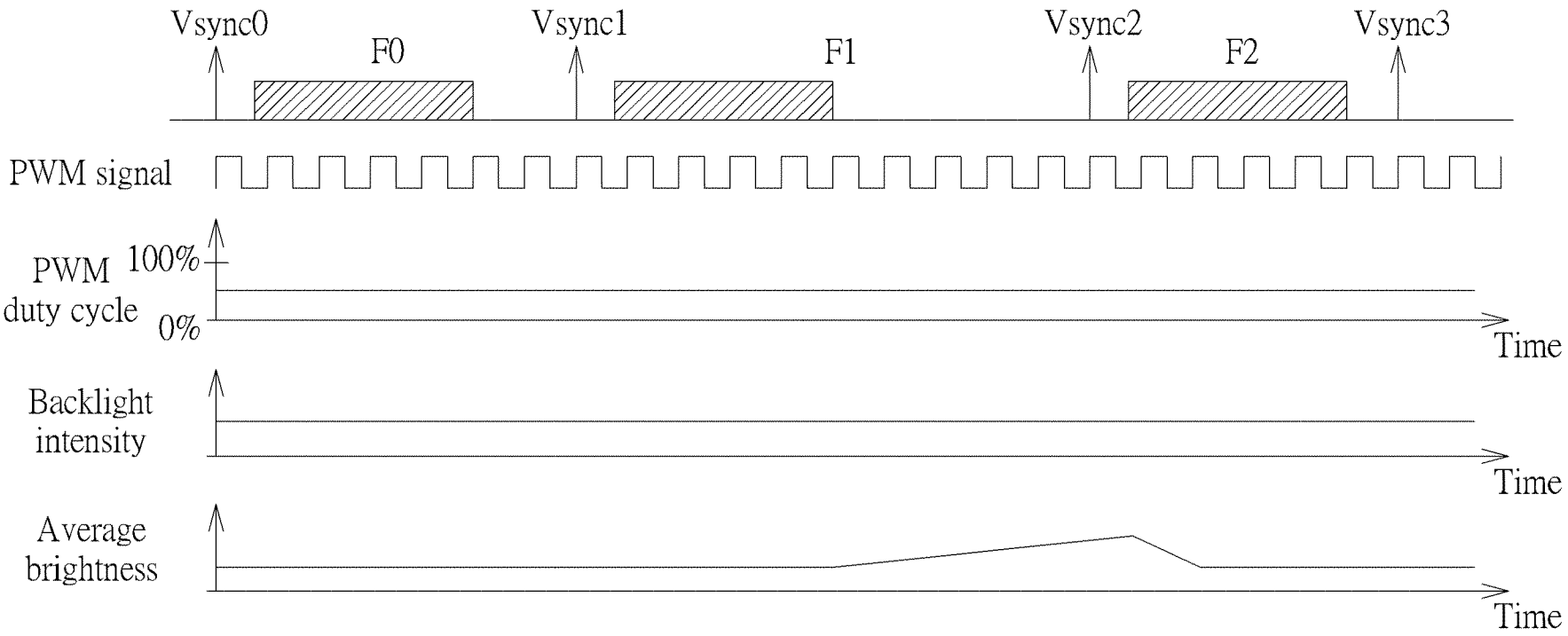
FIG. 5 PRIOR ART
FIG. 5 is a diagram illustrating image brightness and/or color nonuniformity according to the prior art.

FIG. 5 is a diagram illustrating image brightness and/or color nonuniformity according to the prior art. In FIG. 5, it is assumed that the display panel 230 is a normally white LCD panel, the displayed image frames F0, F1, and F2 have a same content, the backlight brightness remains the same, and the frame rate of the image frame F1 is lower than that of the image frame F0. Similar to the case as discussed in the related description of FIG. 3, the image frame F1 in FIG. 5 has a lower frame rate (i.e. the image frame F1 has a longer vertical front porch region). As a result, the average image brightness generated by the display panel 230 in the vertical front porch region of the image frame F1 will gradually increase due to a longer current leakage time of the pixel capacitors. Therefore, the image brightness and/or color is nonuniform.

Figure 6:
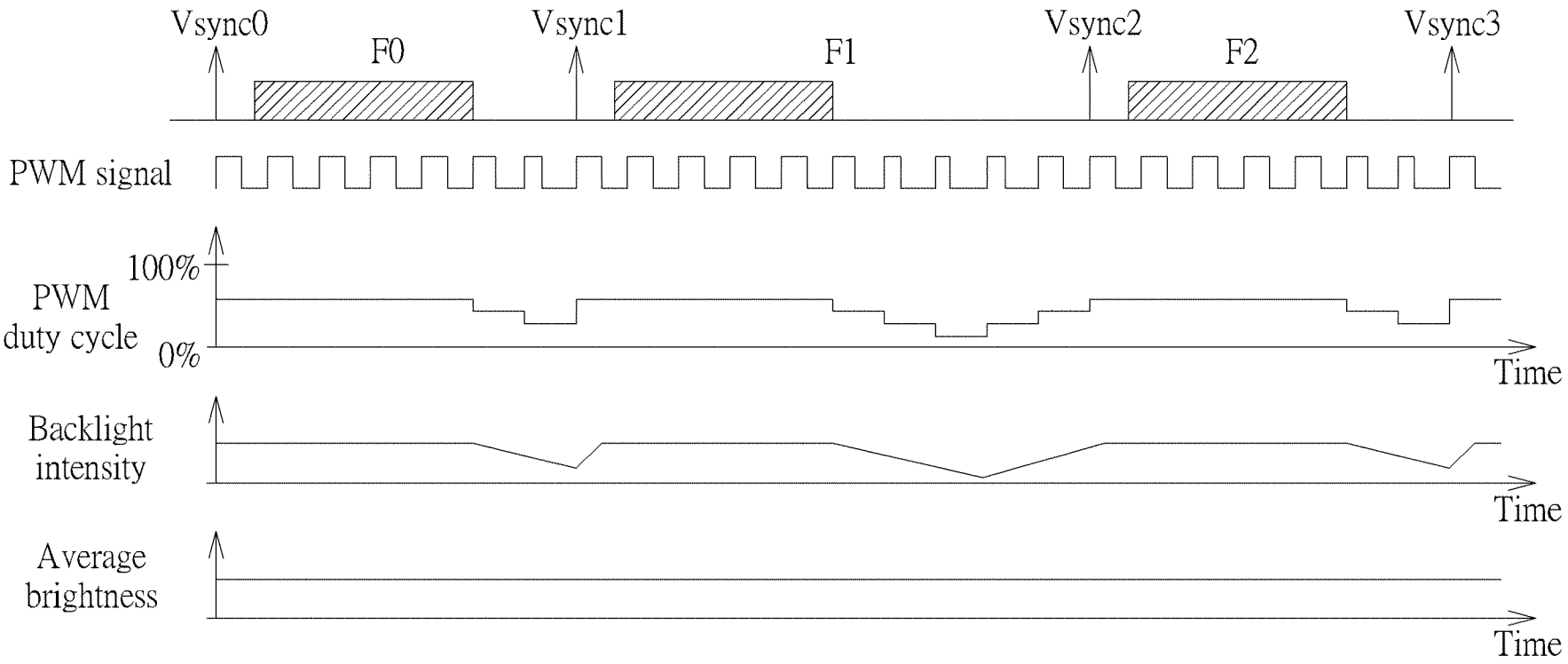
FIG. 6 is a timing diagram illustrating an embodiment of the present invention that is arranged to improve the image brightness and/or color nonuniformity shown in FIG. 5.

To address the problem shown in FIG. 5, please refer to FIG. 6. FIG. 6 is a timing diagram according to an embodiment of the present invention. As shown in FIG. 6, the backlight control circuit 228 determines whether to change the brightness of the backlight module 238 in the vertical front porch region according to the frame rate of the current image frame, to compensate for the increase of the average image brightness due to the longer vertical front porch region of the image frame F1. Specifically, if the image processing circuit 224 determines that the image frame F1 has a lower frame rate, the control signal Vc (e.g. the PWM signal) generated by the backlight control circuit 228 has a longer duty cycle. That is, the backlight module 238 has a lower brightness in the vertical front porch region of the image frame F1, to make the average brightness displayed by the display panel 230 consistent.

It should be noted that, in the embodiment of FIG. 6, the active display region of the image frame F0 and the active display region of the image frame F1 correspond to a same backlight intensity, to maintain a normal frame display. In another embodiment, the active display region of the image frame F0, the active display region of the image frame F1, the vertical back porch region of the image frame F0, and the vertical back porch region of the image frame F1 may correspond to a same backlight intensity.

Figure 7:
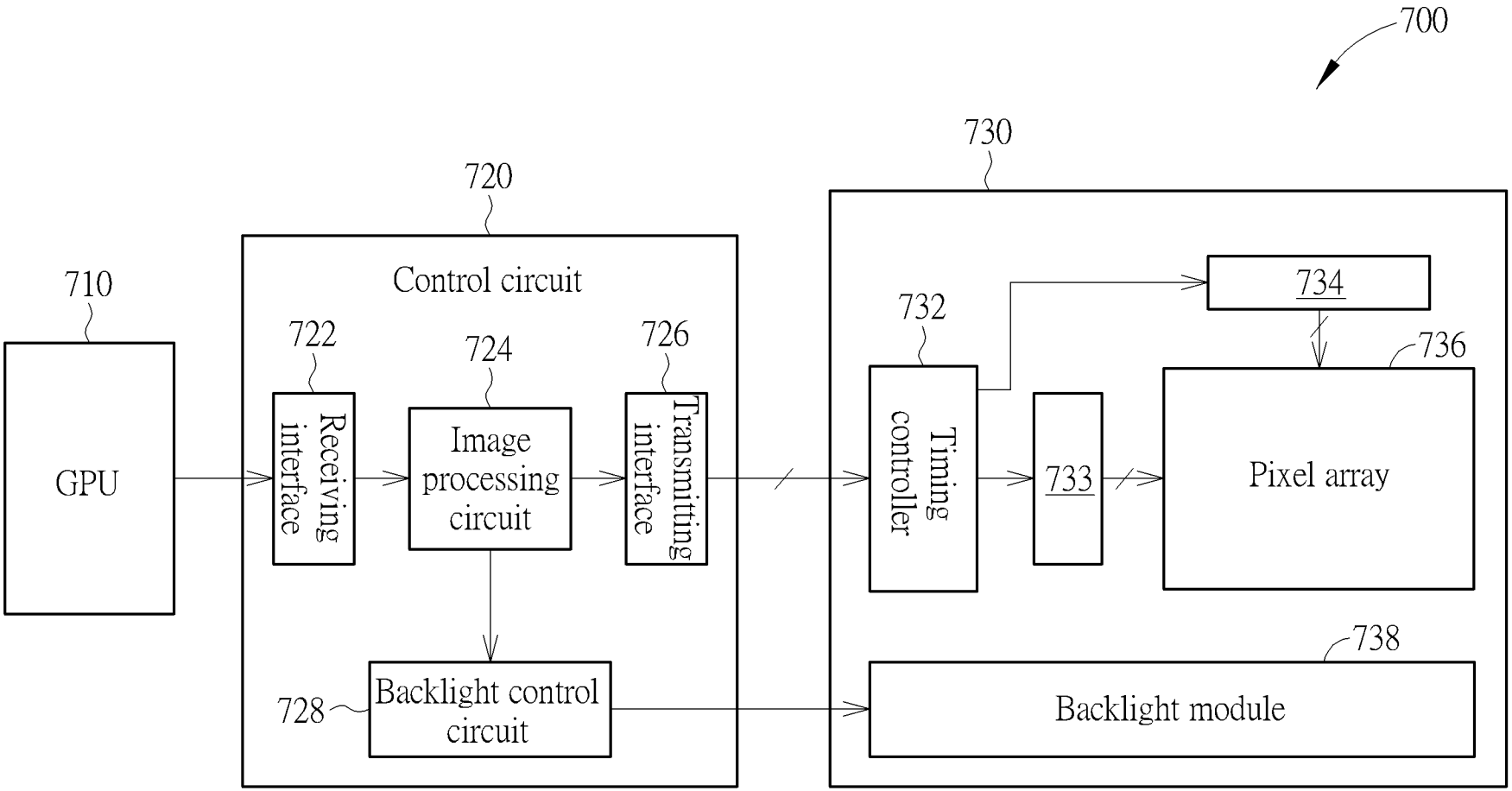
FIG. 7 is a diagram illustrating a display according to another embodiment of the present invention.

FIG. 7 is a diagram illustrating a display 700 according to another embodiment of the present invention. As shown in FIG. 7, the display 700 includes a control circuit 720 and a display panel 730. A graphics processing unit (GPU) 710 of an image source (e.g., a computer) is coupled to the control circuit 720 of display 700. In this embodiment, the control circuit 720 includes a receiving interface 722, an image processing circuit 724, a transmitting interface 726, and a backlight control circuit 728, wherein the receiving interface 722 is arranged to receive an image data from the GPU 710, and then transmit the received image data to the image processing circuit 724 for image processing, and the image processing circuit 724 may adjust brightness, color, or format of the received image data to generate and output an output image data to the transmitting interface 726 that transmits the output image data to the display panel 230 for displaying. In addition, the backlight control circuit 728 is arranged to generate a control signal Vc to control the brightness of the display panel 730, wherein the control signal Vc may be a PWM signal. In an embodiment of the present invention, the control circuit 720 is a scaler integrated circuit. The display panel 730 includes a timing controller 732, a gate driver 733, a source driver 734, a pixel array 736, and a backlight module 738, wherein the timing controller 732 receives an image data from the control circuit 720 and then generates corresponding gate driving signal and source driving signal to the gate driver 733 and the source driver 734, for controlling the pixel array 736 to display an image frame. In addition, the backlight module 738 receives the control signal Vc to illuminate with corresponding brightness.

The display 700 shown in FIG. 7 supports a VRR display method. That is, a frame rate of an output image data generated by the control circuit 720 is equal to a frame rate of an image data generated by the GPU 710. As mentioned in the description of the prior art, a frame rate of images that need to be displayed by the display panel 730 will change with the speed of the GPU 710 generating the image data. As a result, in different frame rates, the pixel array 736 has a large difference in the time of the voltage holding stage, which may cause the brightness and/or color of the displayed image to be different, and may cause the screen to flicker. To address this issue, the present embodiment proposes a display control method, wherein the image processing circuit 724 may adjust the image brightness according to the frame rate of the image frame that is currently processed, to prevent image brightness and/or color nonuniformity.

Figure 8:
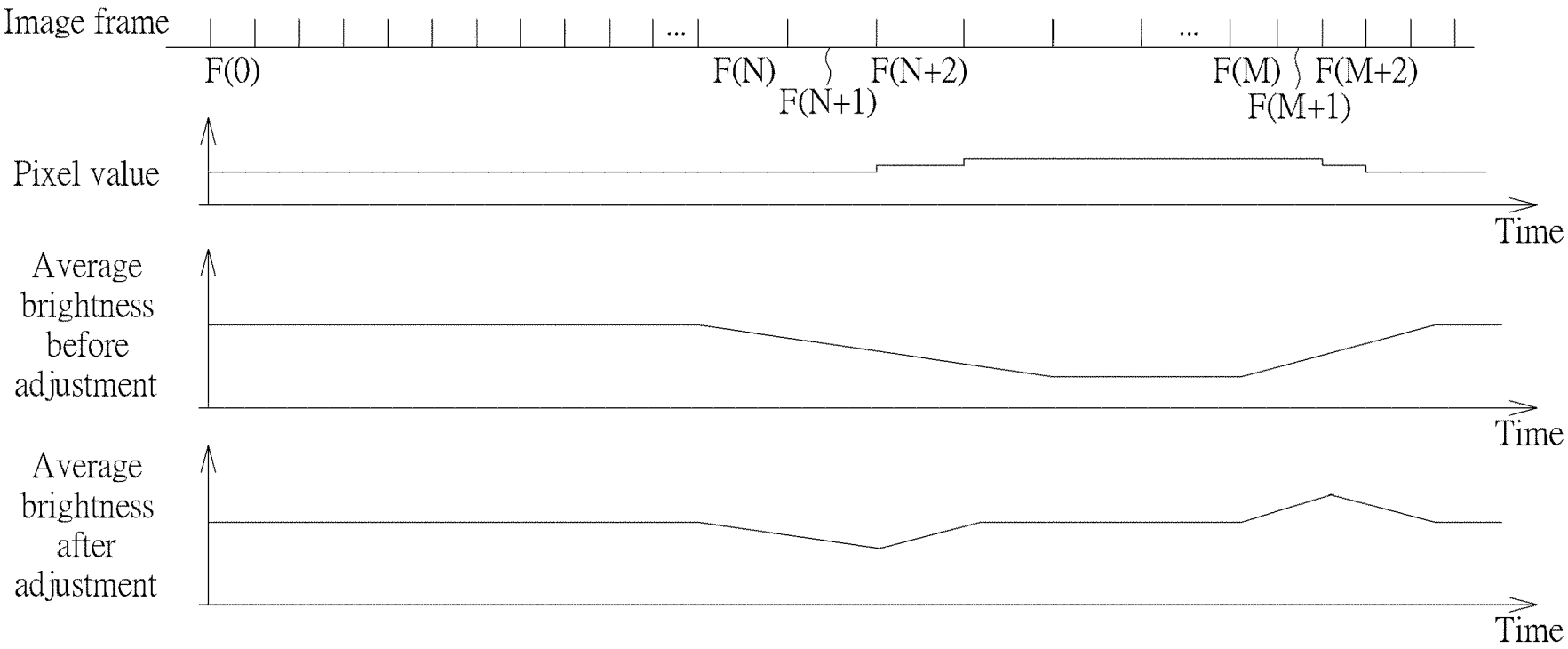
FIG. 8 is a timing diagram illustrating an embodiment of the present invention.

FIG. 8 is a timing diagram according to an embodiment of the present invention. In FIG. 8, it is assumed that the display panel 230 is a normally black LCD panel, the displayed image frame has a same content (e.g. a gray level image, such as the pixel values of red sub-pixels, green sub-pixels, and blue sub-pixels are all 128), and the backlight brightness remains the same (i.e. the PWM signal arranged to control the backlight module has a fixed duty cycle). In FIG. 8, "average brightness before adjustment" is the average brightness in the prior art that does not use the display control method of the present invention, and "average brightness after adjustment" is the average brightness that uses the display control method of the present invention. As shown in FIG. 8, the image frames F(0)-F(N−1) have the same frame rate or frame rates close to each other. As a result, the average brightness will remain at a fixed value. Then, the frame rate starts to decrease since the image frame F(N). As a result, after the image processing circuit 724 detects that the frame rate decreases, the image processing circuit 724 starts to adjust the pixel values of the image frame (e.g. increase the pixel values of the image frame F(N+2)) after the number of buffered frames reaches a certain value, to make the average brightness displayed by the display panel 230 not have much difference. Then, the frame rate starts to increase since the image frame F(M). As a result, after the image processing circuit 724 detects that the frame rate increases, the image processing circuit 724 starts to adjust the pixel values of the image frame (e.g. set the pixel values of the image frame F(M+2) as the original pixel values) after the number of buffered frames reaches a certain value. Please refer to the changes of "average brightness before adjustment" and "average brightness after adjustment" in FIG. 8. The image control method of this embodiment can indeed improve the problem of nonuniformity in image brightness and/or color encountered by the prior art due to the frame rate change.

Figure 9:
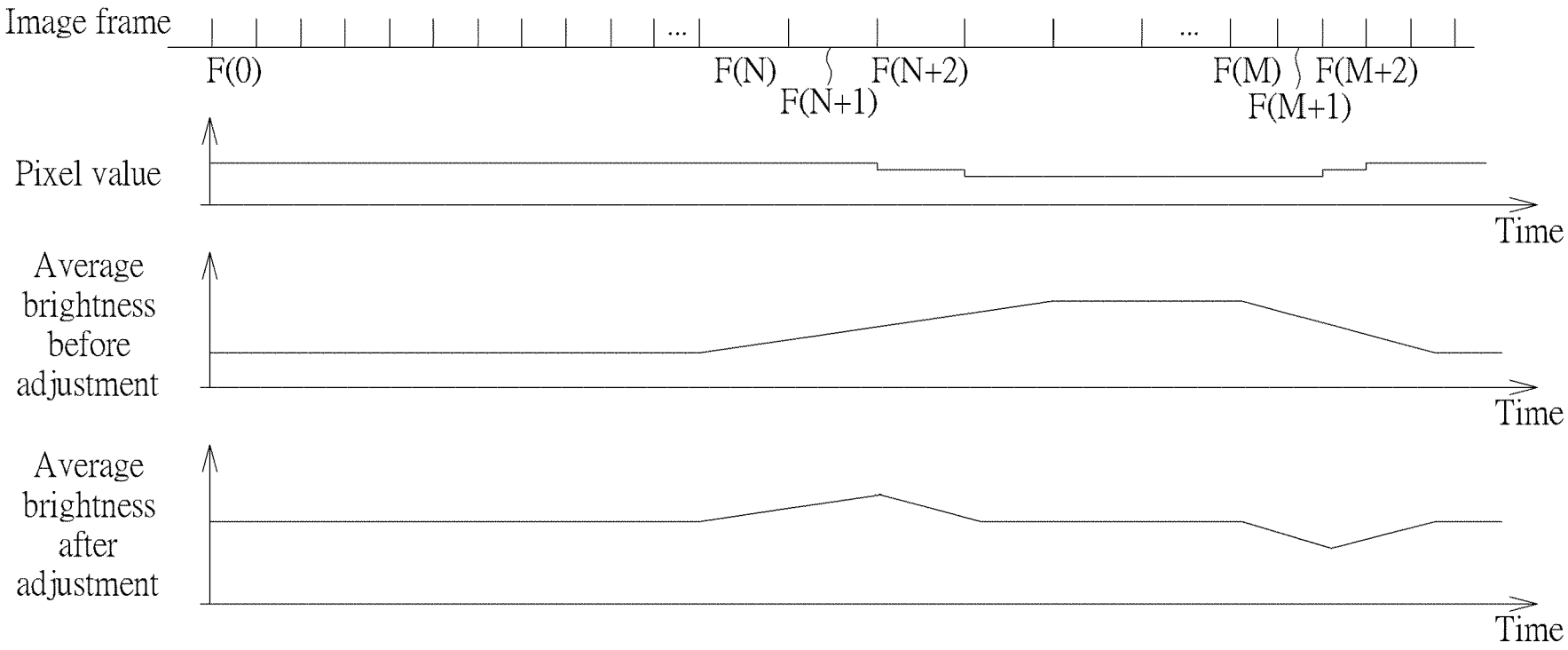
FIG. 9 is a timing diagram illustrating another embodiment of the present invention.

FIG. 9 is a timing diagram according to another embodiment of the present invention. In FIG. 9, it is assumed that the display panel 230 is a normally white LCD panel, the displayed image frame has a same content (e.g. a gray level image, such as the pixel values of red sub-pixels, green sub-pixels, and blue sub-pixels are all 128), and the backlight brightness remains the same. In FIG. 9, "average brightness before adjustment" is the average brightness in the prior art that does not use the display control method of the present invention, and "average brightness after adjustment" is the average brightness that uses the display control method of the present invention. As shown in FIG. 9, the image frames F(0)-F(N−1) have the same frame rate or frame rates close to each other. As a result, the average brightness will remain at a fixed value. Then, the frame rate starts to decrease since the image frame F(N). As a result, after the image processing circuit 724 detects that the frame rate decreases, the image processing circuit 724 starts to adjust the pixel values of the image frame (e.g. decrease the pixel values of the image frame F(N+2)) after the number of buffered frames reaches a certain value, to make the average brightness displayed by the display panel 230 not have much difference. Then, the frame rate starts to increase since the image frame F(M). As a result, after the image processing circuit 724 detects that the frame rate increases, the image processing circuit 724 starts to adjust the pixel values of the image frame (e.g. set the pixel values of the image frame F(M+2) as the original pixel values) after the number of buffered frames reaches a certain value. Please refer to the changes of "average brightness before adjustment" and "average brightness after adjustment" in FIG. 9. The image control method of this embodiment can indeed improve the problem of nonuniformity in image brightness and/or color encountered by the prior art due to the frame rate change.

It should be noted that, the embodiments shown in FIGS. 8 and 9 are used as examples, and the present invention is not limited thereto. As long as the image processing circuit 724 uses different pixel value adjustment amounts to adjust image frames with different frame rates (it is assumed here that the image frames with different frame rates have the same content), the relevant alternative designs (e.g. the number of buffered frames for the image processing circuit 724 to perform pixel value adjustment, the ratio of the pixel value adjustment amounts) all belong to the scope of the present invention.

In summary, in a control circuit of the present invention applied to a display, the control circuit may dynamically adjust the intensity of the backlight module or adjust the pixel values of the image data according to the frame rate of the image data that is currently received. Through the present invention, the problem of different brightness and/or color of the image frame encountered by the prior art due to the frame rate change may be solved, and the display may maintain good display quality under this application.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A control circuit applied to a display, comprising:

a receiving interface, arranged to receive an image data from an image source, wherein the image data has an unfixed frame rate;

an image processing circuit, arranged to receive the image data from the receiving interface, and determine a frame rate of the image data; and a backlight control circuit, arranged to generate a control signal to a display panel according to the frame rate, to control brightness of a backlight module of the display panel;

wherein the image data comprises a first image frame and a second image frame, the first image frame has a first frame rate, the second image frame has a second frame rate, and the backlight control circuit generates the control signal to the display panel, to make the backlight module generates different brightness at the first image frame and the second image frame;

wherein the first image frame comprises a first active display region and a first vertical blanking interval, the second image frame comprises a second active display region and a second vertical blanking interval, the backlight module generates same brightness at the first active display region and the second active display region, and the backlight module generates different brightness at the first vertical blanking interval and the second vertical blanking interval.

2. The control circuit of claim 1, wherein the first vertical blanking interval comprises a first vertical back porch region and a first vertical front porch region, the second vertical blanking interval comprises a second vertical back porch region and a second vertical front porch region, the backlight module generates same brightness at the first active display region, the second active display region, the first vertical back porch region, and the second vertical back porch region, and the backlight module generates different brightness at the first vertical front porch region and the second vertical front porch region.

3. The control circuit of claim 1, wherein when the first frame rate is higher than the second frame rate:

if the display panel is a normally black liquid crystal display panel, the backlight control circuit generates the control signal to the display panel, to make brightness generated by the backlight module at the first image frame lower than that at the second image frame; and if the display panel is a normally white liquid crystal display panel, the backlight control circuit generates the control circuit to the display panel, to make brightness generated by the backlight module at the first image frame higher than that at the second image frame;

wherein when the first frame rate is not higher than the second frame rate:

if the display panel is the normally black liquid crystal display panel, the backlight control circuit generates the control signal to the display panel, to make brightness generated by the backlight module at the first image frame higher than or equal to that at the second image frame; and if the display panel is the normally white liquid crystal display panel, the backlight control circuit generates the control circuit to the display panel, to make brightness generated by the backlight module at the first image frame lower than or equal to that at the second image frame.

4. The control circuit of claim 3, wherein the first image frame comprises a first active display region and a first vertical blanking interval, the second image frame comprises a second active display region and a second vertical blanking interval, the backlight module generates same brightness at the first active display region and the second active display region, and the backlight module generates different brightness at the first vertical blanking interval and the second vertical blanking interval.

5. The control circuit of claim 4, wherein the first vertical blanking interval comprises a first vertical back porch region and a first vertical front porch region, the second vertical blanking interval comprises a second vertical back porch region and a second vertical front porch region, the backlight module generates same brightness at the first active display region, the second active display region, the first vertical back porch region, and the second vertical back porch region, and the backlight module generates different brightness at the first vertical front porch region and the second vertical front porch region.

6. The control circuit of claim 1, wherein the control signal is a pulse-width modulation signal, and the backlight control circuit generates the pulse-width modulation signal with different duty cycles to the display panel, to make the backlight module generates different brightness at the first image frame and the second image frame.

7. A control method applied to a display, comprising:

receiving an image data from an image source, wherein the image data has an unfixed frame rate;

determining a frame rate of the image data; and generating and outputting a control signal to a display panel according to the frame rate, to control brightness of a backlight module of the display panel;

wherein the image data comprises a first image frame and a second image frame, the first image frame has a first frame rate, the second image frame has a second frame rate, and generating the control signal to the display panel according to the frame rate, to control brightness of the backlight module of the display panel comprises:

generating the control signal to the display panel, to make the backlight module generates different brightness at the first image frame and the second image frame;

wherein the first image frame comprises a first active display region and a first vertical blanking interval, the second image frame comprises a second active display region and a second vertical blanking interval, the backlight module generates same brightness at the first active display region and the second active display region, and the backlight module generates different brightness at the first vertical blanking interval and the second vertical blanking interval.

8. The control method of claim 7, wherein the first vertical blanking interval comprises a first vertical back porch region and a first vertical front porch region, the second vertical blanking interval comprises a second vertical back porch region and a second vertical front porch region, the backlight module generates same brightness at the first active display region, the second active display region, the first vertical back porch region, and the second vertical back porch region, and the backlight module generates different brightness at the first vertical front porch region and the second vertical front porch region.

9. The control method of claim 7, wherein generating the control signal to the display panel, to make the backlight module generates different brightness at the first image frame and the second image frame comprises:

in response to the first frame rate being higher than the second frame rate and the display panel being a normally black liquid crystal display panel, generating the control signal to the display panel, to make brightness generated by the backlight module at the first image frame lower than that at the second image frame;

in response to the first frame rate being higher than the second frame rate and the display panel being a normally white liquid crystal display panel, generating the control signal to the display panel, to make brightness generated by the backlight module at the first image frame higher than that at the second image frame;

in response to the first frame rate being not higher than the second frame rate and the display panel being the normally black liquid crystal display panel, generating the control signal to the display panel, to make brightness generated by the backlight module at the first image frame higher than or equal to that at the second image frame; and in response to the first frame rate being not higher than the second frame rate and the display panel being the normally white liquid crystal display panel, generating the control signal to the display panel, to make brightness generated by the backlight module at the first image frame lower than or equal to that at the second image frame.

10. The control method of claim 9, wherein the first image frame comprises a first active display region and a first vertical blanking interval, the second image frame comprises a second active display region and a second vertical blanking interval, the backlight module generates same brightness at the first active display region and the second active display region, and the backlight module generates different brightness at the first vertical blanking interval and the second vertical blanking interval.

11. The control method of claim 10, wherein the first vertical blanking interval comprises a first vertical back porch region and a first vertical front porch region, the second vertical blanking interval comprises a second vertical back porch region and a second vertical front porch region, the backlight module generates same brightness at the first active display region, the second active display region, the first vertical back porch region, and the second vertical back porch region, and the backlight module generates different brightness at the first vertical front porch region and the second vertical front porch region.

* * * * *